US007942159B2

(12) United States Patent
Choi

(10) Patent No.: US 7,942,159 B2
(45) Date of Patent: May 17, 2011

(54) FOLDABLE TENT FRAME

(76) Inventor: Kwan-Jun Choi, kyoungNam (KR)

( * ) Notice: Subject to any disclaimer, the term of this patent is extended or adjusted under 35 U.S.C. 154(b) by 0 days.

(21) Appl. No.: 11/277,649

(22) Filed: Mar. 28, 2006

(65) Prior Publication Data

US 2007/0023074 A1 Feb. 1, 2007

(51) Int. Cl.
*E04H 15/32* (2006.01)
*E04H 15/40* (2006.01)
*E04H 15/48* (2006.01)

(52) U.S. Cl. ..... 135/120.3; 135/126; 135/128; 135/147

(58) Field of Classification Search ..... 135/130, 135/136, 138, 143, 144, 146, 114, 120.3, 135/135, 156, 906; 403/150, 151, 161
See application file for complete search history.

(56) References Cited

U.S. PATENT DOCUMENTS 1,253,123 A * 1/1918 Beard ..... 135/87
4,111,217 A * 9/1978 Victor ..... 135/114
4,192,334 A * 3/1980 Daws ..... 135/135
5,195,551 A * 3/1993 Ju ..... 135/126
5,666,986 A * 9/1997 Fox ..... 135/135
6,679,643 B1 * 1/2004 Ham ..... 403/102
6,959,622 B2 * 11/2005 Masucci ..... 74/493

* cited by examiner

*Primary Examiner* — David Dunn
*Assistant Examiner* — Danielle Jackson

(57) ABSTRACT

The present invention provides a foldable tent frame comprising a certain number of braces and connection sets connecting the adjacent braces, the connection set includes two connection pieces hinged together in dull connection, wherein one connection piece has a cut-away groove along the axial at the open end to form a pair of opposite groove sides, and a through cutting groove formed at the front side crossing the two sides of the cut-away groove; a second connection piece extends a tongue at the front end for plugging into the cut-away groove, and a slotted-eye is formed on the middle portion of the tongue, and coordinating to the cut-away groove, said tongue has a rim formed at the root, and a cam is extended from the surface of the rim coordinating to the cutting groove.

3 Claims, 7 Drawing Sheets

FOLDABLE TENT FRAME

BACKGROUND OF THE INVENTION

1. Field of the Invention

The present invention relates to a foldable tent frame, and more particularly to connection sets connecting the pole to the bottom of a main body of a tent.

2. Description of Prior Art

In accordance with the conventional arts, a foldable tent is consisted of several foldable braces and some connection sets connection adjacent member bars and facilitating to fold. Because of the folding nature of the connection sets for a foldable tent, when a user is pitching up the tent, the positioner of a tent must be used for preventing the member bars from folding under large extra force from outside such as a strong wind or loads such as unexpected striking.

On the other hand, the foldable brace set typically comprises several member bars, which in general includes three or more member bars engaged end by end in dull connection and each nodal point in different position receives different external force of wind, so it endures different stress. Generally, the lower connection sets, facing to the wind in front orientation, bear stronger load of wind; and the upper connection sets bear less load of wind. In addition, due to the secure localization contributed by the connection sets in pitched a tent frame, when it comes to folding the tent, it becomes a concern to a user how to conveniently release the localizing mode of the connection sets, whatever the mechanism of the positioner is, is essential to the users. The lower connection sets located at a reachable height will not cause much trouble to a user, in contrast, the upper connection sets located at a higher position can be a potential problem for some users to reach; therefore, an easy operation positioning mechanism is practically important.

Based on the above, regarding to the foldable tent frame, depending on various locations the connection set should be designed differently for different functions.

OBJECTS AND SUMMARY OF THE INVENTION

It is therefore a main object of the present invention to provide connection sets, which can be firmly located as pitching up, meanwhile, which is also easy to operate when being folded up.

This object is achieved by the following resolutions in the present invention: a foldable tent frame comprised of a certain number of braces connected to each other in dull connection by connection sets; the upper connection set includes two connection pieces hinged together in dull connection, wherein one connection piece has a cut-away groove along the axial at the open end to form a pair of opposite groove sides, and a cutting groove formed at the front side crossing the both sides of the cut-away groove; another connection piece extends a tongue at the front end for correspondently plugging into the cut-away groove, and a slotted-eye is formed on the middle portion of the tongue, and coordinating to the cut-away groove, said tongue has a rim formed at the root, and a cam is extended from the surface of the rim coordinating to the cutting groove; the lower connection set includes two inter-hinged connection pieces, wherein one connection piece has a cut-away groove along the axial at the open end to form a pair of opposite groove sides, and a cutting groove crossing the both sides of the cut-away groove, and a stopping cam with a stopping surface extended out from the open side of the cutting groove approaching to the cut-away groove; another connection piece of the lower connection set extends out a tongue from the front end for engaging into the cut-away groove correspondently with a slotted-eye formed on the middle portion, and coordinating to the outside surface of the cut-away groove, said tongue has a rim formed at the root, and a cam is extended from the surface of the rim coordinating to the cutting groove, said cam stretches a stopping surface along one side for correspondently matching with the stopping surface of the first connection piece.

In said upper connection set, one connection piece with the cut-away groove extends a catching lug from the inner side of the closed end of cut-away groove to form a recess with the bottom side of the cut-away groove; and the another connection piece extends a nose from the tip end of the tongue so that the nose is exactly locked in the recess as the member bars are unfolded; on the other hand, the waist slotted-eye of another connection piece is tilted to the inside and the bottom side.

In said lower connection set, one connection piece with the cut-away groove extends a catching lug from the inner side of the closed end of cut-away groove to form a recess with the bottom side of the cut-away groove; and the another connection piece extends a nose from the tip end of the tongue so that the nose is exactly located in the recess as the member bars are unfolded; on the other hand, the waist slotted-eye of another connection piece is enlarged one end approaching to the inside and the bottom side to form one big end and one small end.

In this case, due to employing the double caging devices in the present invention, such as inter-engaged cutting groove with the cam and the catching lug and the nose, the retaining intension of the connection set is improved greatly so that the pitched tent frame is more stably.

On the other hand, due to the difference load received in different nodal point located in different place in the wind, the mechanism of connection set in each nodal point is designed in different. Regarding to the upper connection set, due to higher place located and smaller load received, so the easy operation is focused on, so that the catching depth of the cutting groove and the cam is designed into shallow for facilitating to release once withdrawing the catch-in force, therefore, do not need to draw out the both connection pieces with both hands as folding up the tent frame, just need to eliminate the intensity of the tent frame, and turn the member bars around the pivoted point of the connection set with a little force, the tent frame can be folded easily, even if the user is short.

Regarding to the lower connection set, confined by its lower location and stronger load received from wind, the bearing capacity is the main concern in design, therefore, the contacting surfaces of the cut-away groove and the cam is stretched out to form a pair of stopping surfaces to increase the engaging area, so that the two connection pieces are inter-locked tightly to improve the bearing capacity without any anxious about collapsing even under stronger wind as pitching up the tent frame. And when folding this nodal point, just draw out the engaged two connection pieces with the both hand, the tent frame can be folded easily, due to the lower place of the nodal point, the operation is became easier.

DETAILED DESCRIPTION OF PREFERRED EMBODIMENTS

Referring to FIG. 1 to FIG. 13, the tent disclosed in the present invention is comprised of a certain number of braces 1 connected to each other in dull connection by connection sets; in the present embodiment, a three-panel structure is described in details; the upper connection set A is used for connecting the top and the middle braces 1, and the lower connection set B connects the middle to the low braces 1 for facilitating folding the whole frame.

Figure 1:
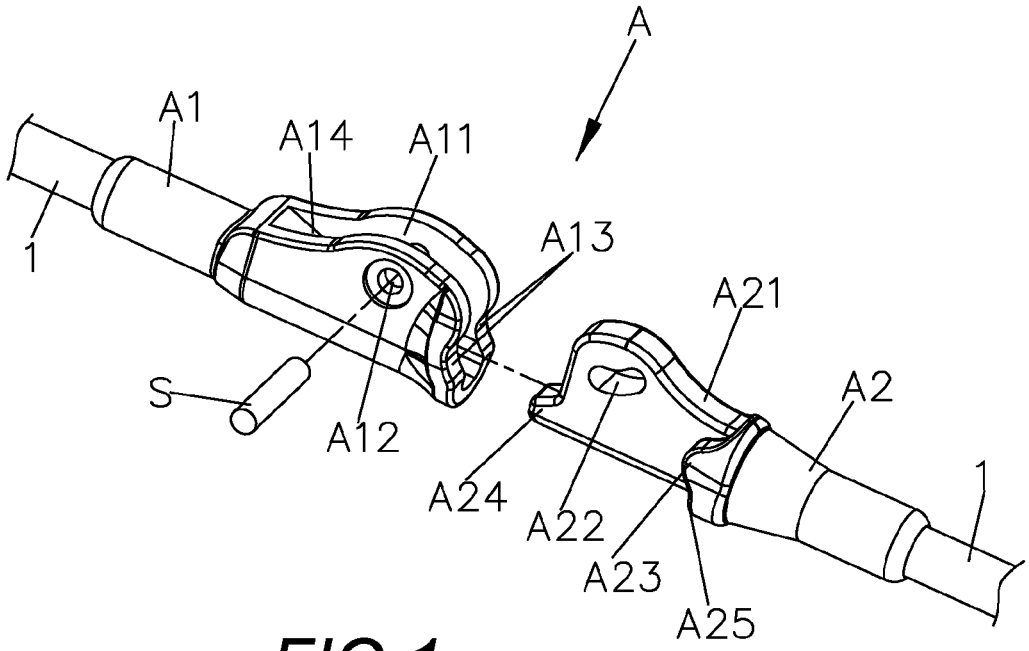
FIG. 1 is an exploded view showing the upper connection set of the present invention.
Figure 2:
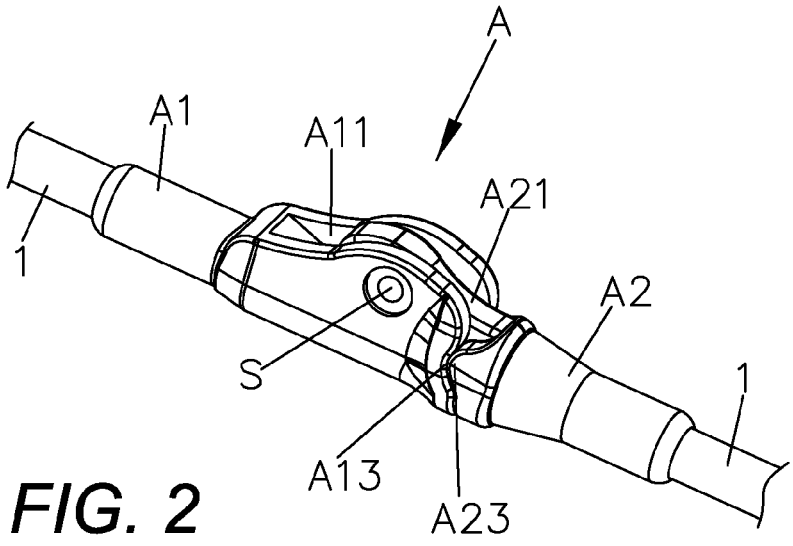
FIG. 2 is a scheme showing the combined upper connection set of the present invention.
Figure 3:
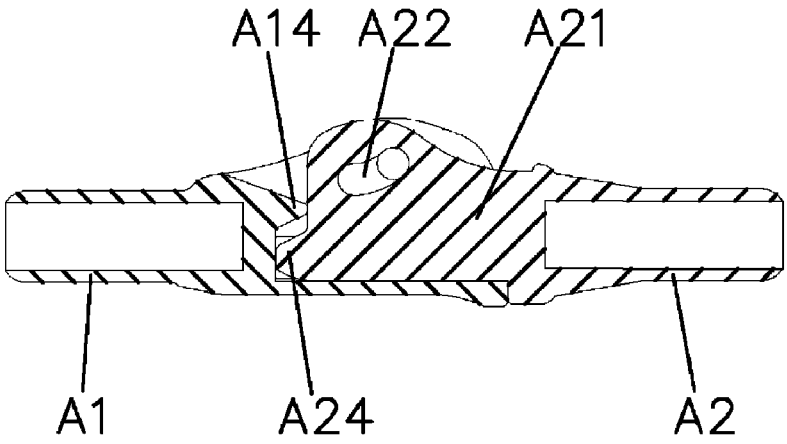
FIG. 3 is a sectional view showing the engaging state of the upper connection set of the present invention.

Referring to FIG. 1 to FIG. 3, said upper connection set A includes two connection pieces Al and A2 hinged together in dull connection, and their outside ends are respectively fixed on the coordinating tip ends of the up and the middle braces 1. Wherein one connection piece A1 has a cut-away groove A11 along the axial at the open end thereof to form a pair of opposite groove sides, and a through pin hole A12 drilled crossing the two groove sides, and a cutting groove A13 formed crossing the front ends of the two sides of the cut-away groove A11, wherein said cutting groove A13 is a curved groove; the cut-away groove extends a catching lug A14 from the inner side of the closed end to form a recess between the catching lug A14 and the bottom side of the cut-away groove A11.

A connection piece A2 extends a tongue A21 at the front end thereof for correspondently plugging into the cut-away groove A11, and a slotted-eye A22 is formed in the middle portion of the tongue A21 so that a rivet S passes through and rivets on the pin hole A12 to hinge the two connection pieces A1 and A2 together, and coordinating to the outside surface of the cut-away groove A11, said tongue A21 has a rim A25 formed at the root, and a cam A23 is extended from the top end surface of the rim A25 coordinating to the cutting groove A13, in addition, the tongue A21 extends a nose A24 from the tip end so that the nose can be caught in the recess formed between the catching lug A14 and the bottom side of the cut-away groove A11 to securely lock on the catching lug A14.

Figure 4:
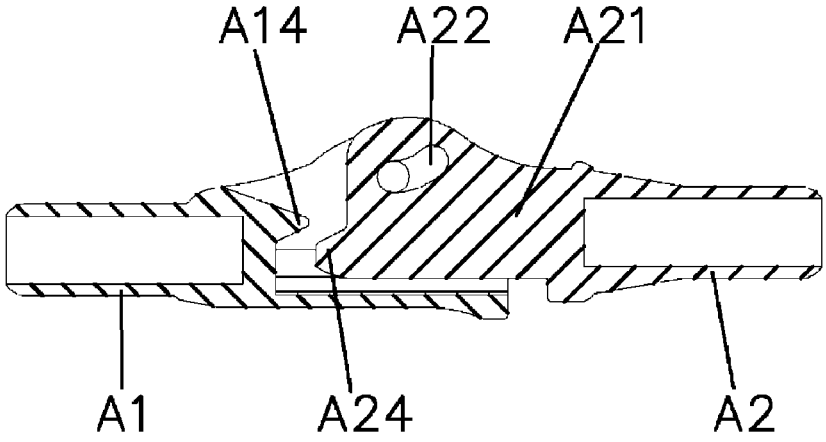
FIG. 4 is a sectional view showing the disengaging state of the upper connection set of the present invention.
Figure 5:
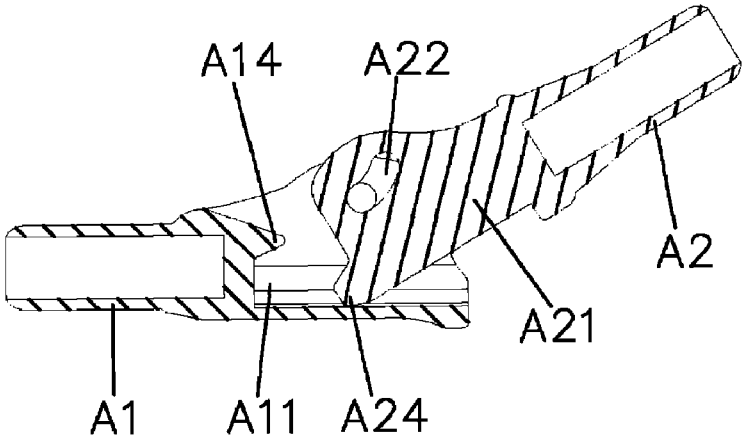
FIG. 5 is a sectional view showing the folding action of the upper connection set of the present invention.
Figure 6:
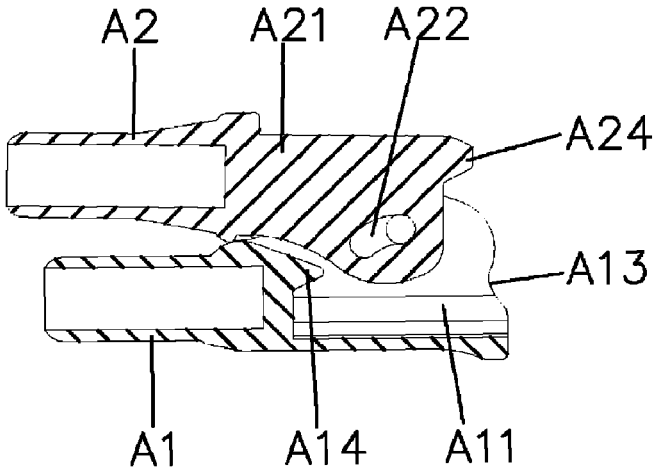
FIG. 6 is a sectional view showing the folded state of the upper connection set of the present invention.

Referring to FIG. 4 to FIG. 6, when folding the upper connection set A, a user only needs to draw out the two connection pieces A1 and A2 outward for the cam A23 of the connection piece A2 slides off from the cutting groove A13 of the connection piece A1, and at the same time, the nose A24 slides off from the recess to release the lock of the catching lug A14; the last step is to fold up both connection pieces A1 and A2 together. For preventing the nose A24 of the connection piece A2 from interfering with the bottom side of the cut-away groove A11, said slotted-eye A22 of the connection piece A2 is cut into tilting to the inside and the bottom side; referring to FIG. 4, when disengaging the two connection pieces A1 and A2, the tilted slotted-eye A22 will lift the connection piece A2 up so that the nose A24 will not interfere with the bottom side of the cut-away groove A1 when being turned around the rivet S (as shown in FIG. 5).

Figure 7:
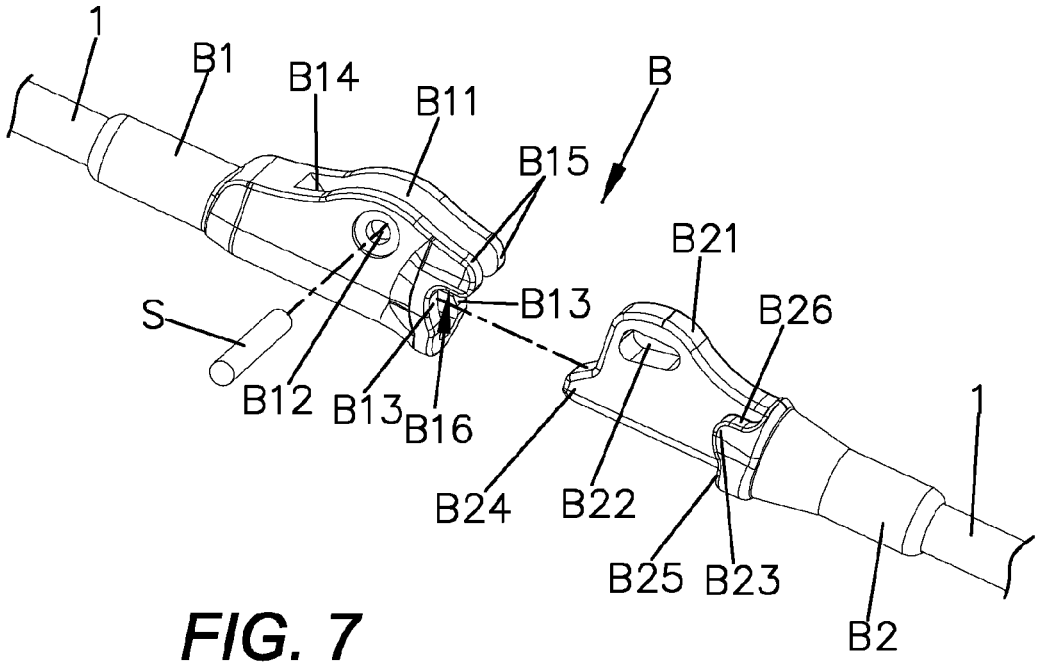
FIG. 7 is an exploded view showing the lower connection set of the present invention.
Figure 8:
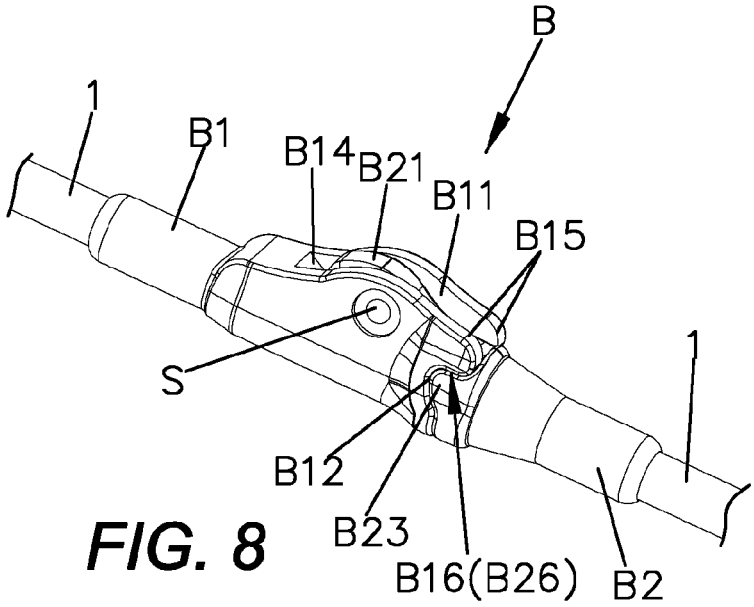
FIG. 8 is a solid view showing the combined lower connection set of the present invention.
Figure 9:
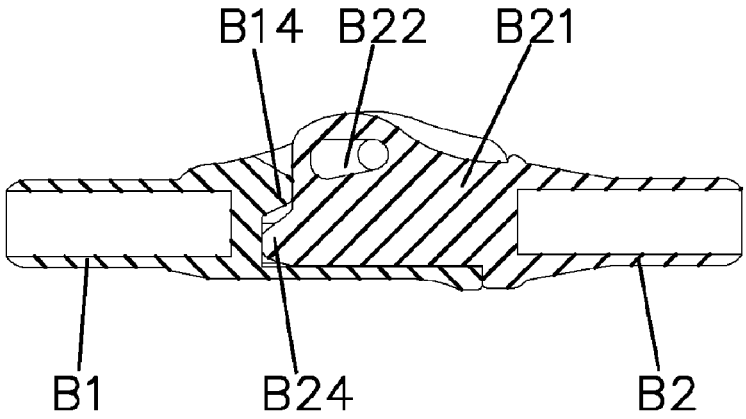
FIG. 9 is a sectional view showing the engaging state of the lower connection set of the present invention.

Referring to FIG. 7 to FIG. 9, the lower connection set B includes two inter-hinged connection pieces B1 and B2, and their outside ends are respectively fixed on the coordinating tip ends of the up and the middle braces 1. Similarly to the above-mentioned connection set A in the structures of the connection pieces A1 and A2, the lower connection set B also includes a pair of socket-joined cut-away groove B11 and the tongue B21, by riveting the pin hole B12 to the slotted-eye B22 with a rivet S, and engaging the cutting groove B13 and the cam B23, and inter-locking the catching lug B14 and the nose B24, moreover the rim B25 formed on the root of the tongue B21 coordinating to the outside surface of the cut-away groove B11, and the nose B24 is projected from the rim B25, the two connection pieces B1 and B2 are hinged and inter-locked together. The differences between the upper connection set A and the lower connection set B are as follows:

As to connection piece B1, the through cutting groove B13 crossing the cut-away groove B11 extends out a stopping cam B15 on each side respectively to form an extended stopping surface B16, and the cam B23 of another connection piece B2 has a stopping surface B26 corresponding to the stopping surface B16. For a better securing effect of inter-engaged two stopping surfaces B16 and B26, the two stopping surfaces B16 and B26 are formed in an acute angle.

Figure 10:
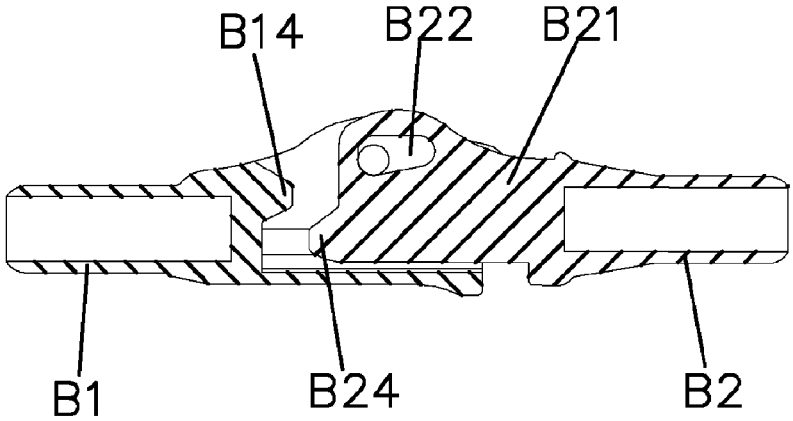
FIG. 10 is a sectional view showing the disengaging state of the lower connection set of the present invention.
Figure 11:
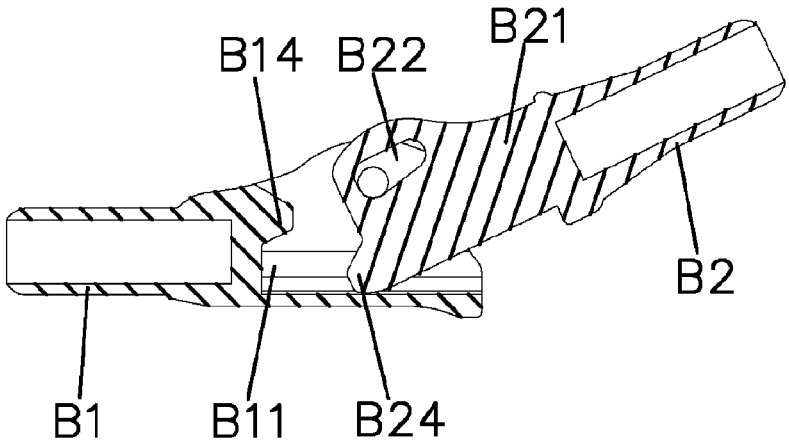
FIG. 11 is a sectional view showing the folding action of the lower connection set of the present invention.
Figure 12:
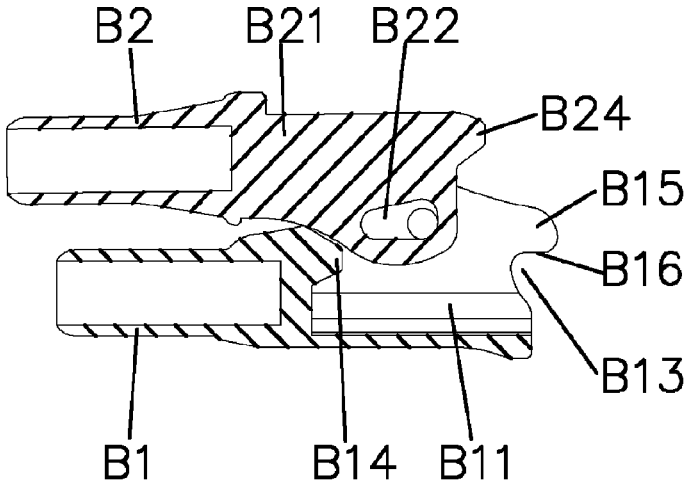
FIG. 12 is a sectional view showing the folded state of the lower connection set of the present invention.

In addition, the waist slotted-eye B22 of connection piece B2 is oversized at one end approaching the inside and the bottom side to form an end and of larger size, while the other end is of smaller size. In this case, when folding the lower connection set B, as shown in FIG. 10 to FIG. 12, a user would open up the two connection pieces B1 and B2 so that the cam B23 slides out from the cutting groove B13 of the connection piece B2, meanwhile, the nose B24 is simultaneously released from the inter-locked catching lug B14; while sliding off between the two connection pieces B1 and B2, the oversized end of the slotted-eye B22 is leaving more space for lifting the connection piece B2 up so that the nose B24 will not interfere with the bottom side of the cut-away groove B11 (as shown in FIG. 11).

Figure 13:
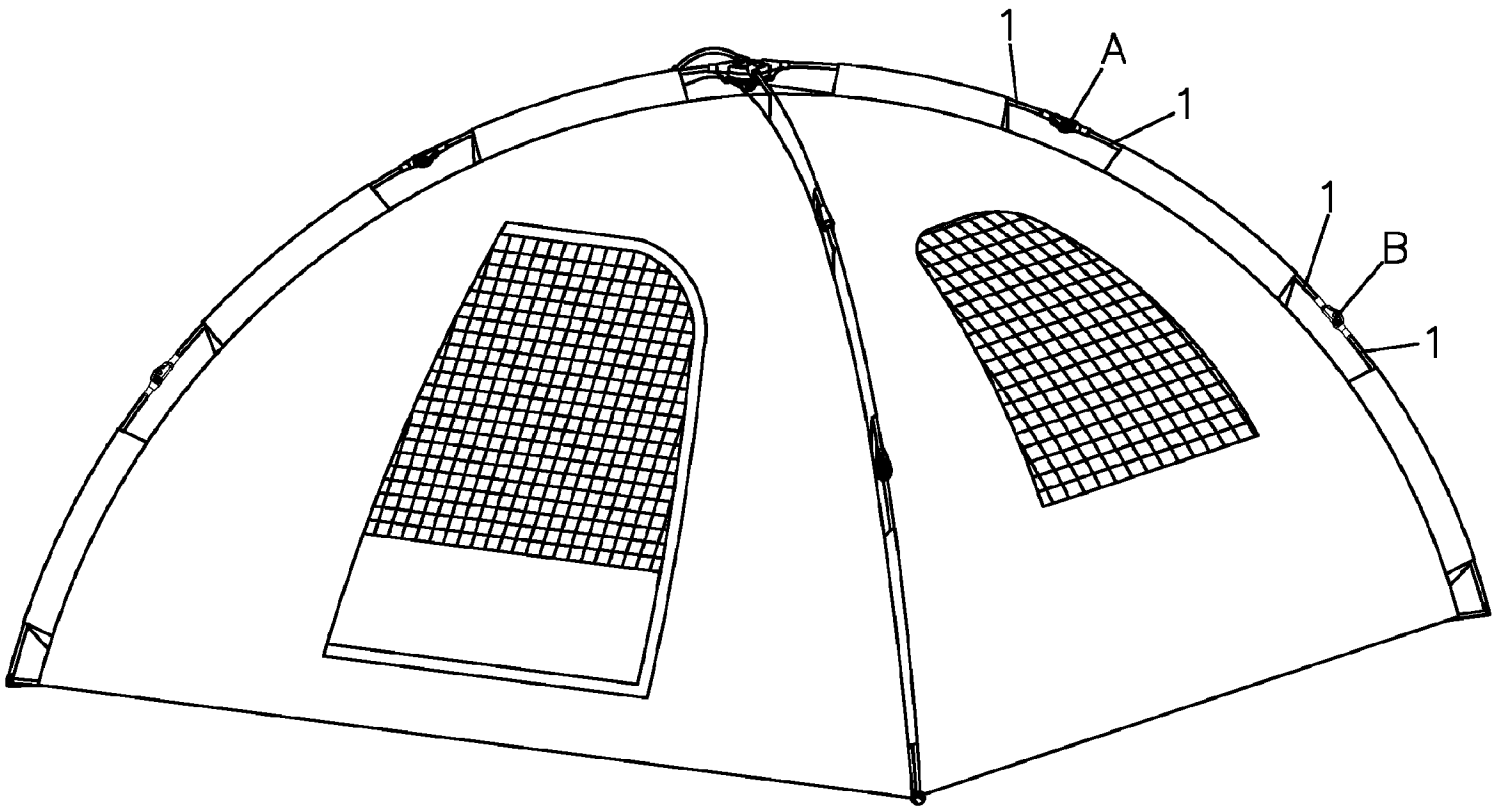
FIG. 13 is a scheme showing the using state of the present invention.

Referring to FIG. 13, the connection sets disclosed in the present invention are used in a foldable tent frame, when the tent is being opened up for use, under the stretching force of the whole tent frame, connection sets A and B receive a pair of opposite forces on the nodal point so that each cam A23 and B23 catches into the corresponding cutting groove A13 and B13, respectively, to be firmly secured in position, preventing connection sets A and B from folding and instead staying in a stable inter-locking state. On the other hand, due to the double caging devices in the present invention, i.e. inter-engaged cutting grooves A13 and B13 with the cams A23 and B23, respectively, and inter-locked connection between the catching lugs A14 and B14, and between the noses A24 and B24, the retaining intensions of the connection sets are improved greatly. Moreover, regarding to the lower connection set B, due to the inter-engaged stopping surfaces B16 and B26 of the cutting groove B13 and the cam B23, when pitching up the tent frame, the two connection pieces B1 and B2 are locked together firmly to hold out a potential strong wind, avoiding possible falling-down.

When folding up the tent frame, due to emulating the stretching force of the whole tent frame out, all the nodal points are in free, regarding to the lower connection set B, the user just need to draw away the two connection pieces B1 and B2, the connection set B can be closed together, due to it locates in a lower place, so the operation is easy. And regarding to the upper connection set A, due to the shallow engaging depth of the cutting groove A13 and the cam A23, even once the opposite forces coming from the stretching force of the whole tent frame are emulated, the two connection pieces A1 and A2 can be fallen off, in this time, the user just draws the connection set A along the closing direction, the rivet S will slide along the slotted-eye A22 to lift another connection piece A2 up, meanwhile the two connection pieces A1 and A2 are closed in this processing, therefore, although the upper connection set A is located in the higher place, the operation is certainly easy and convenient, even to the shorter user, it is easy too. Although the bearing intension of the upper connection set A is smaller than the lower connection set B, because it receives smaller wind force, but also it is enough for bearing strong wind without any falling down.

I claim:

1. A foldable tent frame, comprising:

a plurality of braces;

connection sets connecting said plurality of braces, wherein said connection sets include an upper connection set and a lower connection set;

wherein said upper connection set includes a first upper connection piece and a second upper connection piece, hinged together in dull connection;

said first upper connection piece includes:

a cut-away groove including a pair of opposing groove sides, the cut-away groove being formed along an axial and having an open end thereof; and a through cutting groove formed at the open end of the cut-away groove and extending across the entire width of said pair of opposing groove sides;

said second upper connection piece includes:

a tongue extending from a front end thereof for plugging into said cut-away groove;

a slotted-eye formed in the center of said tongue;

a rim formed at a root of the tongue; and a cam extending from a surface of said rim and coordinating with said through cutting groove;

wherein said lower connection set includes a first lower connection piece and a second lower connection piece, inter-hinged with each other;

said first lower connection piece includes:

a lower cut-away groove including a pair of lower opposing groove sides, the lower cut-away groove being formed along a lower axial and having a open end thereof;

a lower cutting groove extending across the entire width of said pair of lower opposing groove sides; and a lower stopping cam with a lower stopping surface extended out from the open end of said lower cut-away groove;

said second lower connection piece includes:

a lower tongue extending from a front end thereof for plugging into said lower cut-away groove;

a lower slotted-eye formed in the center of said lower tongue;

a lower rim formed at a lower root of the lower tongue; and a lower cam extending from a surface of said lower rim and coordinating with said lower cutting groove, wherein said lower cam engages the lower stopping surface.

2. A foldable tent frame as claimed in claim 1, wherein an upper catching lug extends from an inner side of a closed end of said cut-away groove to form recess with a bottom side of said cut-away groove; and a nose extends from said tongue for locking in said recess as said braces are unfolded; wherein said slotted-eye of said second connection piece is tilted towards said inner side and said bottom side thereof.

3. A foldable tent frame as claimed in claim 1, wherein a lower catching lug extends from an inner side of a closed end of said cut-away groove to form a lower recess with a bottom side of said cut-away groove; and a lower nose extends from said lower tongue for locking in said lower recess as the braces are unfolded; wherein said lower slotted-eye of said second lower connection piece has a large end and a small end, the large end being oversized compared to the small end and located near said inner side and said bottom side.

* * * * *